US009640010B2

(12) United States Patent
Katagiri et al.

(10) Patent No.: US 9,640,010 B2
(45) Date of Patent: May 2, 2017

(54) COIN PROCESSING DEVICE

(71) Applicant: NIPPON CONLUX CO., LTD., Sakado-shi, Saitama (JP)

(72) Inventors: Ryoji Katagiri, Sakado (JP); Naoki Katagiri, Sakado (JP)

(73) Assignee: NIPPON CONLUX CO., LTD., Sakado-shi (JP)

( * ) Notice: Subject to any disclaimer, the term of this patent is extended or adjusted under 35 U.S.C. 154(b) by 0 days.

(21) Appl. No.: 14/914,719

(22) PCT Filed: Aug. 4, 2014

(86) PCT No.: PCT/JP2014/070465
§ 371 (c)(1),
(2) Date: Feb. 26, 2016

(87) PCT Pub. No.: WO2015/029702
PCT Pub. Date: Mar. 5, 2015

(65) Prior Publication Data

US 2016/0210806 A1 Jul. 21, 2016

(30) Foreign Application Priority Data

Aug. 30, 2013 (JP) ..... 2013-179568

(51) Int. Cl.
*G07D 9/00* (2006.01)
*G07F 5/24* (2006.01)
*G07D 11/00* (2006.01)

(52) U.S. Cl.
CPC ..... *G07F 5/24* (2013.01); *G07D 11/0051* (2013.01); *G07D 11/0063* (2013.01); *G07D 11/0078* (2013.01)

(58) Field of Classification Search
CPC .. G07F 5/24; G07F 9/006; G07D 1/00; G07D 1/02; G07D 11/0051; G07D 11/0063; G07D 11/0078; G07D 2205/00
See application file for complete search history.

(56) References Cited

U.S. PATENT DOCUMENTS 4,369,442 A * 1/1983 Werth ..... G07F 9/08 194/217
5,924,081 A * 7/1999 Ostendorf ..... G06Q 40/12 700/231

FOREIGN PATENT DOCUMENTS

JP 63-143982 U 9/1988
JP 7-141540 A 6/1995
JP 2013-134653 A 7/2013

OTHER PUBLICATIONS

International Search Report of PCT/JP2014/070465, dated Oct. 7, 2014. [PCT/ISA/210], (3 pages).
(Continued)

*Primary Examiner* — Mark Beauchaine
(74) *Attorney, Agent, or Firm* — Sughrue Mion, PLLC

(57) ABSTRACT

The present invention has the purpose of providing a coin processing device capable of performing a coin reception test while being connected with a vending machine.
When a response command from the vending machine is received while a test mode is executed, a response is carried out to the response command based on device information present immediately before the test mode is executed, reception of a coin thrown during the test mode is stored, and the coin is paid out based on the storage when the test mode is released.

2 Claims, 3 Drawing Sheets

(56) References Cited

OTHER PUBLICATIONS

Written Opinion of PCT/JP2014/070465, dated Oct. 7, 2014. [PCT/ISA/237], (3 pages).

* cited by examiner

COIN PROCESSING DEVICE

CROSS REFERENCE TO RELATED APPLICATIONS

This application is a National Stage of International Application No. PCT/JP2014/070465 filed Aug. 4, 2014, claiming priority based on Japanese Patent Application No. 2013-179568, filed Aug. 30, 2013, the contents of all of which are incorporated herein by reference in their entirety.

TECHNICAL FIELD

The present invention relates to a coin processing device, in particular to a coin processing device arranged in a device such as a vending machine, which receives and pays out coins.

BACKGROUND ART

In general, a coin processing device which receives and pays out coins (see Patent document 1, for example) is mounted on a vending machine, the mounted coin processing device being connected with the vending machine by harness.

The harness is configured by combining an electric power source line for the coin processing device to be supplied with electric power from a power source arranged in the vending machine and a communication line for communication between the coin processing device and a main control of the vending machine.

As shown above, between the vending machine and the coin processing device connected by harness, the vending machine regularly transmits a response command to the coin processing device via the harness, and the coin processing device transmits a response (information showing a current situation) to the response command. Besides, the coin processing device is operated based on a command transmitted from the vending machine.

By the way, the coin processing device sometimes faces an abnormal situation where coins cannot be received for any reason. In such a case, when the vending machine fails to receive any response from the coin processing device, the vending machine transmits a reset signal to the coin processing device, and the coin processing device which receives the reset signal is cut out from electric power supply from the vending machine, and then returns to the original state to be shifted to the initial operation.

Also, the coin processing device sometimes does not receive any coins even when the coin processing device can transmit a response to a response command from the vending machine. This case suggests the possibility where any malfunction is occurring in the coin processing device, or the vending machine is directing the coin processing device not to receive any coins due to any malfunction on the vending machine side such as abnormality of a goods sellout sensor of the vending machine or abnormality of an open/close sensor of the door of the vending machine, and thus, any confirmation operation should be performed by a person in charge of maintenance, etc. of the vending machine.

It is noted that, in the coin processing device which has received the reset signal, the value in the soft counter (see Patent document 2, for example) counting coins capable of being paid out is also initialized.

PRIOR ART DOCUMENTS

Patent Documents

Patent document 1: Japanese Patent Application Laid-open No. H07-141540

Patent document 2: Japanese Patent Application Laid-open No. 2013-134653

SUMMARY OF INVENTION

Problem to be Solved by Invention

When the coin processing device does not receive any coins due to the direction from the vending machine side, it is possible that the vending machine itself is operated normally. Conventionally, however, because of the fact that, the coin processing device, while being connected with the vending machine, was controlled by a direction (command) from the vending machine, it was impossible to determine whether no coin was received due to any direction form the vending machine side, or any abnormality was occurring in the coin processing device side, merely by throwing a coin to perform a reception test.

In addition, when the coin processing device was operated against the command from the vending machine, the reset signal was sometimes received, and thus, no coin reception test could be performed on the coin processing device merely by ignoring command from the vending machine.

In contrast, when the coin processing device was disconnected from the vending machine, since the coin processing device could be provided with no electric power from the vending machine, a person in charge of maintenance, etc. had to bring the coin processing device back to a service center, etc. to inspect the coin processing device alone by connecting the device with a jig which could supply electric power. Needless to say, when the abnormality was caused by the malfunction of the vending machine, no malfunction in the coin processing device could be found.

Accordingly, the present invention has the purpose of providing the coin processing device capable of performing a coin reception test while being connected with the vending machine.

Means to Solve the Problem

In order to achieve the above purpose, the invention in claim 1 is characterized with a coin processing device being supplied with electric power from a vending machine, which receives a response command from the vending machine including a reset signal which represents restart execution and responds to the received response command, the coin processing device comprising operation reception means for receiving operation for executing and releasing a test mode, test mode execution means for executing the test mode according to the operation received by the operation reception means, when the test mode execution means executes the test mode, device information storage means for storing device information present immediately before the test mode is executed, if the response command from the vending machine is received while the test mode execution means executes the test mode, response means for carrying out a response to the response command based on the device information stored in the device information storage means, while the test mode execution means executes the test mode, reception information storage means for storing reception of thrown coins, and, when the test mode is released according to the operation received by the operation reception means, paying out means for paying out coins based on the storage of the reception information storage means.

Also, the invention in claim 2 is characterized, in the invention in claim 1, in that, while the test mode execution mains executes the test mode, the reception information storage means stores the thrown coins as number of coins according to each denomination.

Effect of the Invention

According the present invention, the test mode in which availability of coin reception is tested can be executed while the connection with the vending machine is maintained and the electric power is supplied, and, when the test mode is executed, the state of the coin processing device present before the execution of the test mode can be maintained.

EMBODIMENT FOR IMPLEMENTING THE INVENTION

Shown below is the detailed explanation regarding one embodiment of the coin processing device in the present invention referring to the attached drawings.

Embodiment

Figure 1:
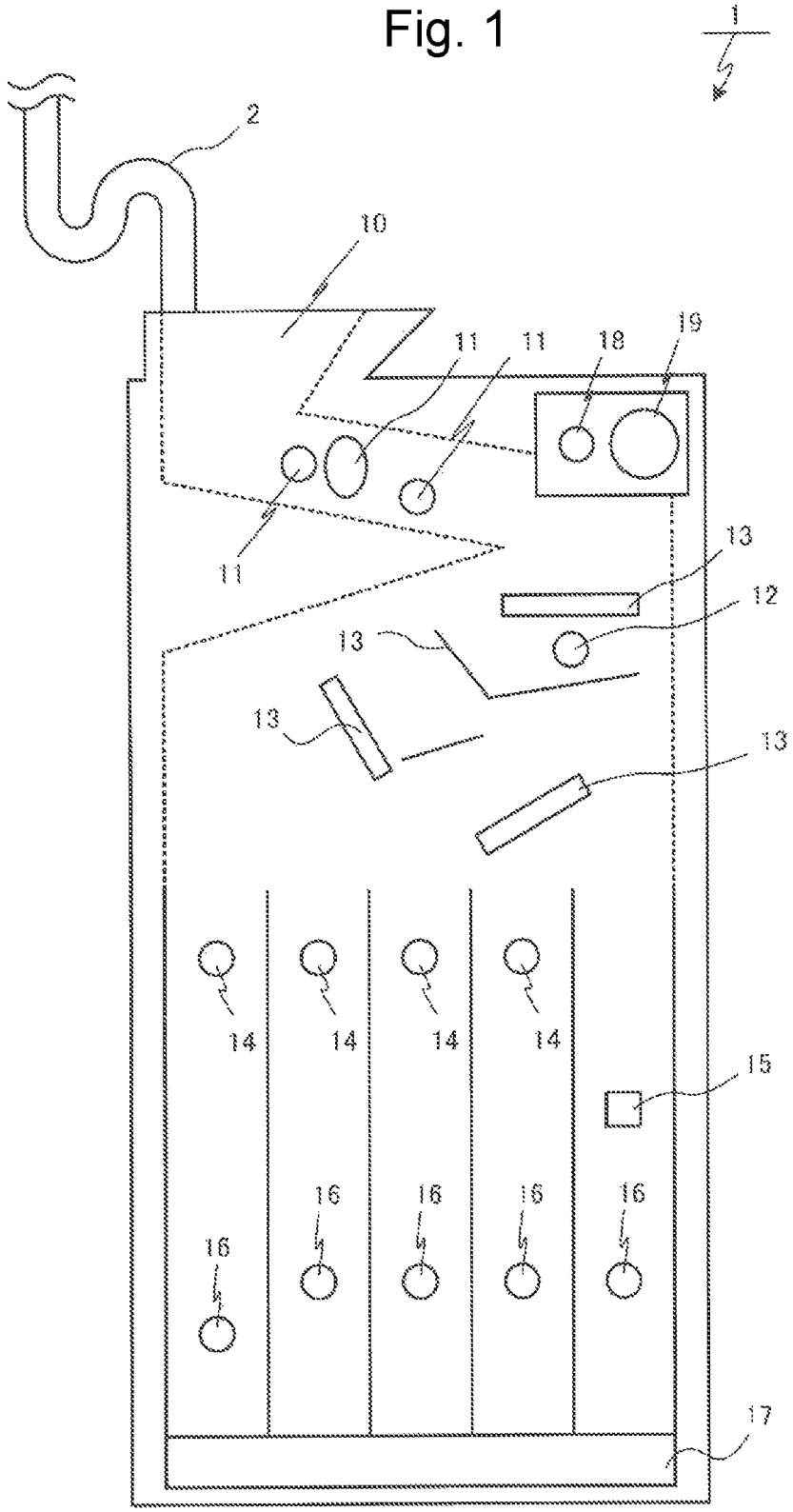
FIG. 1 shows the outline of configuration example of the coin processing device.

FIG. 1 shows the outline of configuration example of the coin processing device, and represents the section of the coin processing device schematically.

As shown in FIG. 1, the coin processing device 1 comprises a coin throwing port 10, an identification sensor 11, a reception detection sensor 12, a distribution part 13, full state detection sensors 14, a cassette removal detection sensor 15, empty sensors 16, a paying out part 17, an indicator lamp 18, and an operation button 10. Also, the coin processing device 1 is supplied with electric power from the vending machine not shown on the drawing, and is connected by the harness 2 for communicating with the vending machine.

A coin is thrown into the coin throwing port 10.

The identification sensor 11 is a group of a plurality of sensors for inspecting material, diameter, and design, etc. of coins which are thrown from the coin throwing port 10 and relatively move in the coin processing device 1.

The coin reception is detected by the reception detection sensor 12. It is noted that any coin determined as not genuine (forged, or not eligible for the reception) based on the material, diameter, and design, etc. of the coin detected by the identification sensor 11 is discharged by the operation of the distribution part 13 before the coin reaches the position where the reception detection sensor 12 is arranged, and thus, is not inspected by the reception detection sensor 12.

The distribution part 13, based on the detection result by the identification sensor 11, receives the coin determined as genuine by the controller mentioned below, and furthermore distributes the received coin to a corresponding position in a coin tube according to the denomination determined by the controller mentioned below. Also, when the coin tube has been detected as full by the full state detection sensors 14, the received coin is distributed to a safe not shown in the drawing. Also, when an object is determined as not a genuine coin, the distribution part 13 does not work. In this case, the thrown object which is not a genuine coin is guided to a return slot. Also, when any reception inhibition signal from the main control of the vending machine is received, the coin processing device performs no identification, and the distribution part 13 does not work. In this case, the thrown coin is directly guided to the return slot, as well.

The full state detection sensors 14 respectively detect the coins accumulated in the coin tube as having reached the full state. It is noted that, in the coin tube, no full state detection sensor is arranged in the position where coins used solely for paying out are accumulated.

The cassette removal detection sensor 15 detects cassette removal in the coin tube.

The empty sensors 16 respectively detect the state in which more number of coins are accumulated than predetermined in the coin tube. The predetermined number varies according to the position where an empty sensor 16 is arranged and thickness of the accumulated coins.

The paying out part 17 selectively pays out the coins accumulated in the coin tube by payout slide and change slide, and the paying out operation is performed by electric power with the use of a motor or solenoid, etc.

The indicator lamp 18 shows by being lighted up that the coin processing device 1 is operated in "test mode" where the coin reception is tested.

The operation button 19 enables the coin processing device 1 to be operated in the "test mode" where the coin reception is tested.

Figure 2:
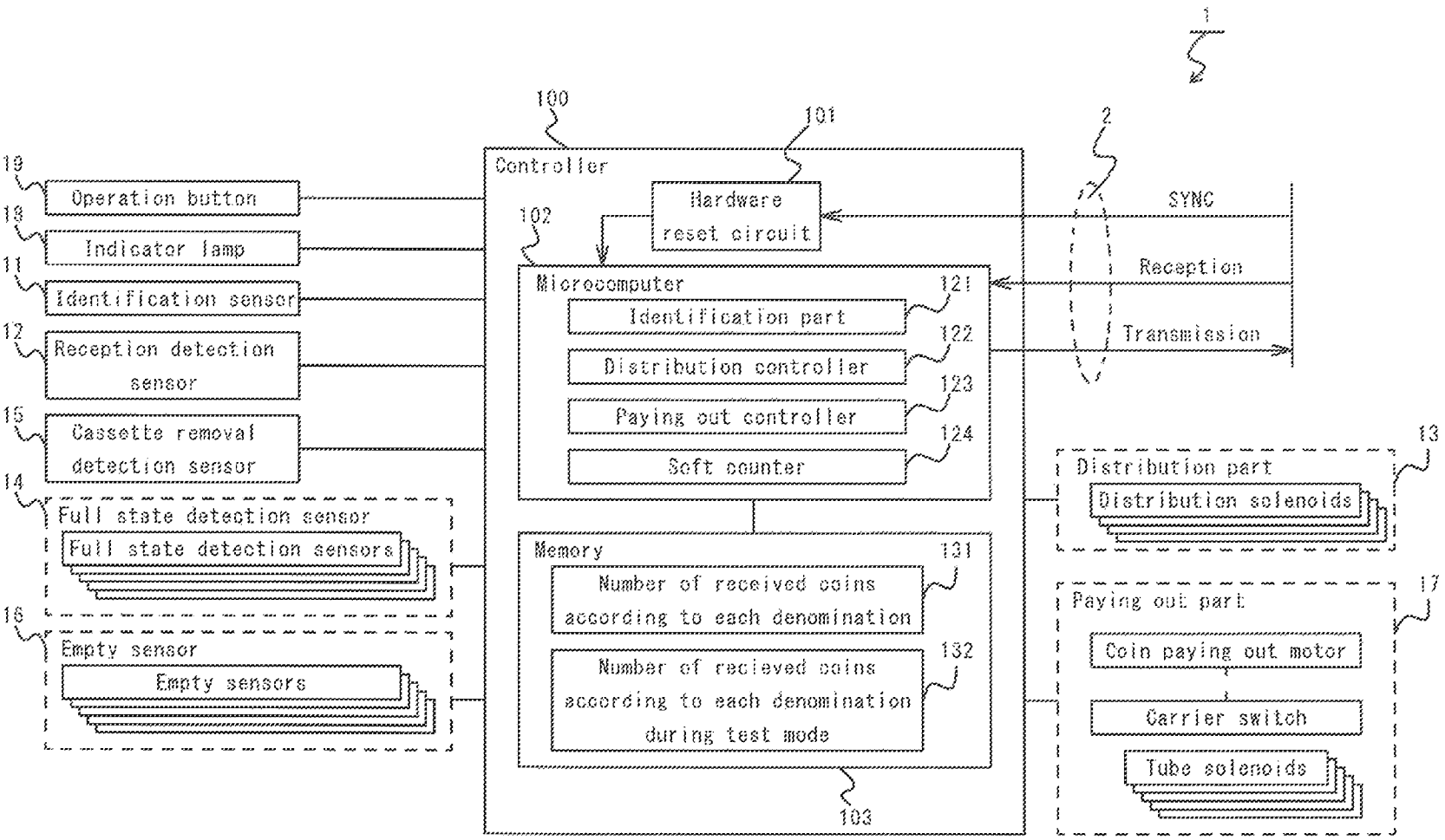
FIG. 2 shows the configuration example of the controller of the coin processing device 1.

Next, the controller for controlling the coin processing device 1 is explained. FIG. 2 shows the configuration example of the controller of the coin processing device 1.

As shown in FIG. 2, the controller 100 is communicably connected with the vending machine via the harness 2, obtains output signals of the identification sensor 11, the reception detection sensor 12, the full state detection sensors 14, the cassette removal detection sensor 15, the empty sensors 16, and the operation button 19, and outputs control signals which control the operations of the distribution part 13, the paying out part 17, and the indicator lamp 18. The harness 2 comprises three communication lines of SYNC signal line, a reception line for receiving a command from the vending machine, and a transmission line for outputting information to the vending machine.

Also, the controller 100 has a hardware reset circuit 101 and a microcomputer 102, and a memory 103.

The hardware reset circuit 101 forcibly resets (restarts) the microcomputer 102 when the reset signal is received from the vending machine. The reset signal is transmitted by the SYNC signal line. The vending machine usually outputs by the use of the SYNC signal line the SYNC signal where the potential regularly becomes LOW level, and then transmits the command (directing to transmit the current state, in the standby state) by the use of the reception line, and, when no response from the coin processing device to the command is received, the vending machine is operated so as to transmit the reset signal where the LOW level is longer than in the SYNC signal.

The microcomputer 102 is a functional part where integrated processors or memories, etc. and software such as programs function together, where each function part such as an identification part 121 for determining authenticity or denomination of coins based on the output result of the identification sensor 11, a distribution controller 122 for controlling the operation of the distribution part 13 based on the determination result of the identification part 121, a paying out controller 123 for grasping accumulation situation of the coins of each denomination based on the calculation result by a soft counter 124, notifying the vending machine main controller of the amount of money capable of being paid out, determining the denomination to be paid out as changes, and controlling the paying out part 17, etc., and the soft counter 124 for calculating the accumulation situation of the coins of each denomination based on the output signals of the reception detection sensor 12, the full state detection sensor 14 and the empty sensors 16 and the operation result of the paying out part 17, etc. is realized.

The memory 103 is a memory element such as RAM (Random Access Memory), which stores the calculation result by the soft counter 124 as a number of received coins according to each determination 131, and stores a number of coins received according to each denomination during the test mode as a number of received coins according to each determination during the test mode 132. Also, the coin processing device 1 constantly stores the device state (device information) in the memory 103.

Figure 3:
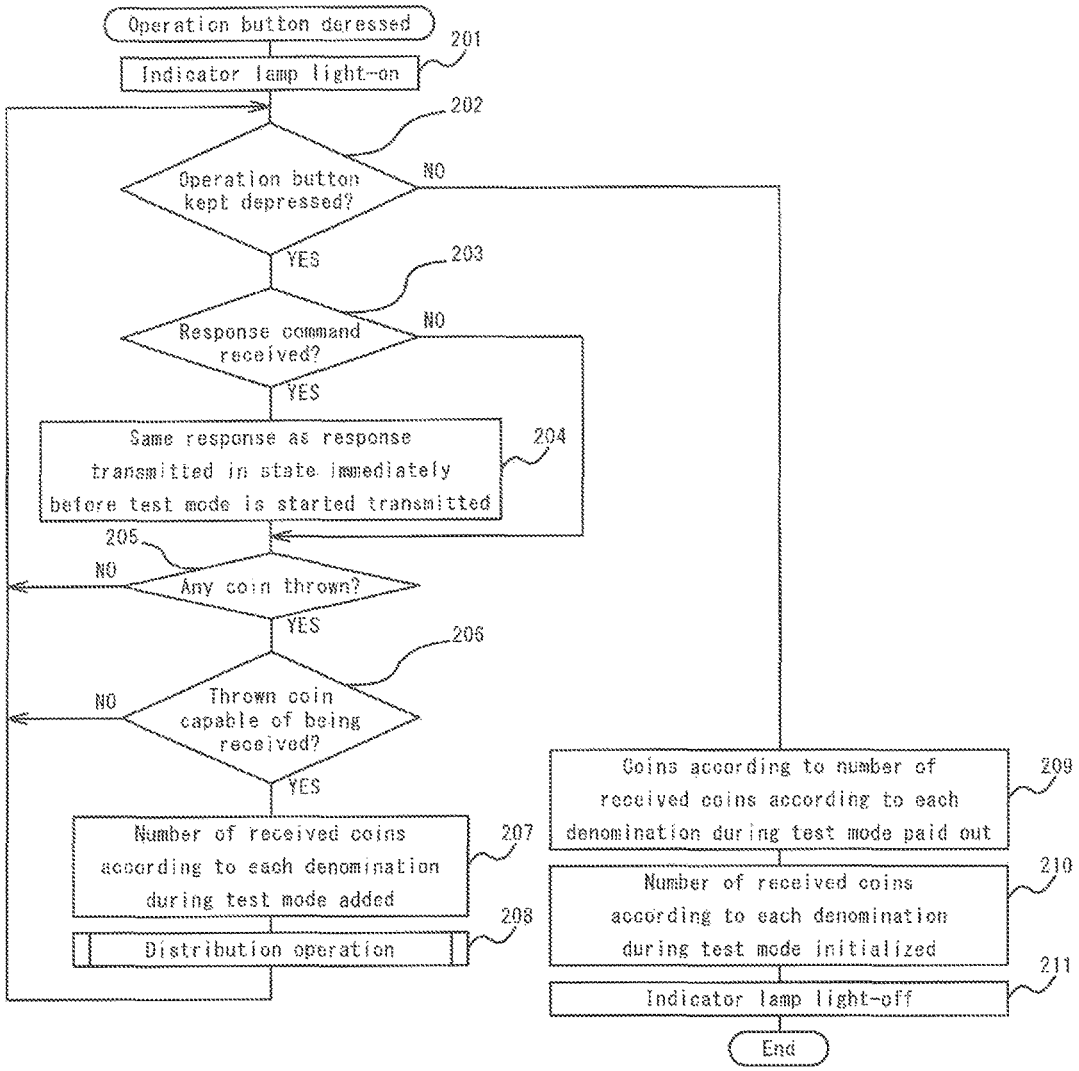
FIG. 3 shows the flow of operation of the coin processing device 1 in the test mode.

Next, it is explained how the coin processing device 1 is operated in the test mode. FIG. 3 shows the flow of operation of the coin processing device 1 in the test mode.

In the coin processing device 1 in the standby state, depressing the operation button 19 starts the operation in the test mode, and the operation in the test mode is maintained while the operation button 19 is kept depressed.

In the coin processing device 1, when the operation in the test mode is started, the controller allows the coins to be received, even the controller is subject to such command as the command for inhibiting reception of coins, from the outside such as the vending machine. Also, in the coin processing device 1, the state present immediately before the test is started (device information) stored in the memory 103 is retained during the test mode.

Next, the controller 100 outputs the control signal for lighting the indicator lamp 18 (Step 201). Then, if the response command from the vending machine is received (YES in Step 203) while the operation button 19 is kept depressed (YES in Step 202), the controller 100 transmits to the vending machine the same response as the response transmitted in the case where the response command is received in the state present immediately before the test mode is started (standby state) (Step 204). During the test mode, the person in charge of maintenance, etc. is performing an operation with the door of the vending machine opened, and with the vending machine being kept in the standby state, and at this moment, the vending machine issues the response command for requesting to notify the number of coins capable of being paid out as changes. Therefore, the notification in the response which the coin processing device 1 transmits in Step 4 is based on the number of received coins according to each determination 131 stored in the memory 103. This notification enables the vending machine to determine that the coin processing device 1 is being operated normally, and instead of transmitting the reset signal, the vending machine issues the response command again alter a given time.

Also, in the coin processing device 1, if it is detected based on the sensor output signal of the identification sensor 11 that any coin is thrown from the coin throwing port 10 (YES in Step 205) while the operation button 19 is kept depressed (YES in Step 202), it is determined based on the sensor output signal of the identification sensor 11 whether or not the thrown coin is capable of being received (namely, genuineness and denomination are determined). Here, if the coin is determined as genuine (YES in Step 206), the thrown coin is received by the operation of the distribution part 13 initiated by the controller 100, and the detection result in the identification sensor 11 and the reception detection sensor 12 (denomination of the received coins and the received number) is stored in the memory 103 through the addition in the soft counter 124 (Step 207), and continuously, the coin received by the operation of the distribution part 13 initiated by the controller 100 is received in the corresponding position in the coin tube (Step 208).

It is noted that, in the case where any coin is thrown into the coin throwing port 10, if it is set so that any coin reception is inhibited in the coin processing device 1 itself (does not represent any reception inhibition by the command from the vending machine), if no coin can be identified due to the abnormality of the identification sensor 11, etc., or if the distribution part 13 does not work, etc., namely if the coin processing device 1 is in abnormal state, the controller 100 does not (cannot) operate the distribution part 13, and thus, the thrown coin is guided to the coin return slot in the vending machine 1 (NO in Step 206).

Also, in the coin processing device 1, when the operation button 19 is released from being depressed (NO in Step 202), the controller 100 controls the paying out part 17 based on the number of received coins according to each denomination during the test mode 132 stored in the memory 103, and the same amount of coins as the coins thrown during the test mode are paid out in the same denomination as the nomination of the thrown coins (Step 209). Then, the number of received coins according to each denomination during the test mode 132 stored in the memory 103 is initialized (Step 210), the controller 100 outputs the control signal for lighting off the indicator lamp 18 to light off the indicator lamp 18 (Step 211), and the test mode is finished. When the test mode is finished, the coin processing device 1 returns to the standby mode.

As explained above, in the coin processing device 1, when the response command is received from the vending machine during the test mode, the state of the coin processing device 1 (device state) present before the test mode stored in the memory 103 is transmitted, and thereby, any reception of the reset signal during the test mode is prevented. Therefore, even when the coin processing device 1 is connected with the vending machine, it can be confirmed whether or not the coin processing device 1 can receive any coins (it is noted that, any transmission of the coin reception information during the test mode to the vending machine by the coin processing device 1 while the coin processing device 1 is subject to the coin reception inhibition command from the vending machine side can be regarded by the vending machine side as the action against the command, and lead to reception of the reset signal.)

Furthermore, when the test mode is finished, paying out the coins used in the coin reception test prevents the coins other than sales from being kept in the device, and the number of received coins according to each denomination 131 stored in the memory 103 is maintained as the value present before the test mode is executed. Thereby, the coin processing device 1 is capable of being returned to the same state as the state before the test.

As mentioned above, since the coin processing device 1 in the one embodiment in the present invention comprises operation reception means (Operation button 19) for receiving operation for executing and releasing the test mode, test mode execution means (Microcomputer 102) for executing the test mode according to the operation received by the operation reception means, when the test mode execution means executes the test mode, device information storage means (Memory 103) for storing device information present immediately before the test mode is executed, if the response command from the vending machine is received while the test mode execution means executes the test mode, response means (Microcomputer 102) for carrying out a response to the response command based on the device information stored in the device information storage means, while the test mode execution means executes the test mode, reception information storage means (Memory 103) for storing reception of thrown coins, and when the test mode is released according to the operation received by the operation reception means, paying out means (Paying out part 17) for paying out coins based on the storage of the reception information storage means, the test mode in which availability of coin reception is tested can be executed while the connection with the vending machine is maintained and the electric power is supplied, and, after the test mode is executed, the state of the coin processing device can be maintained as the state before the execution of the test mode.

It is noted that, in addition to the explanation above that the test mode is executed while the operation button 19 is kept depressed, it is also possible to arrange so as to start the test mode by depressing the operation button 19 one time and to finish the test mode by depress the operation button 19 again.

In addition, it is also possible to arrange so as to start the test mode by depressing the operation button 19 one time and to finish the test mode by receiving one coin or by receiving each one coin of all the denomination. In this case, the number of received coins according to each denomination during the test mode 132 can be arranged so as to represent information (such as a flag) showing whether or not any coin has been received, instead of the received number.

Furthermore, in the case where the coins received in the test mode are intended to be accommodated in the coin tube, if the corresponding coin tube is full, the coins are guided to the safe. In this case, the number of received coins according 10 each denomination during the test mode 132 is not changed so that no paying out is performed when the test mode is finished. Thereby, the number of coins which can be paid out, namely the number of received coins according to each denomination 131 can be maintained as the value present before the test mode is executed.

Furthermore, it is also possible to arrange so as to execute the test mode only for a given time alter the operation button 11 is depressed. For example, it may be arranged so that the test mode is executed only for ten seconds alter the button is depressed one time, and then finished.

In addition in the test mode, when the test mode continues for a long time, it is possible that the test mode state is maintained not by the operator's intention but due to the switch malfunction. Therefore, it is also possible to arrange so that the test mode is forcibly finished after a given time (such as ten minutes) has passed in order that the normal standby state can be automatically recovered even in such a case as shown above. In this case, when the test mode is forcibly finished, the test mode may be finished without any paying out operation due to such operation of the worker in charge of the coin processing device such as removing the cassette.

DESCRIPTION OF THE REFERENCE NUMERALS

1 Coin processing device
10 Coin throwing port
11 Identification sensor
12 Reception detection sensor
13 Distribution part
14 Full state detection sensors
15 Cassette removal detection sensor
16 Empty sensors
17 Paying out part
18 Indicator lamp
19 Operation button
100 Controller
101 Hardware reset circuit
102 Microcomputer
103 Memory
121 Identification part
122 Distribution controller
123 Paying out controller
124 Soft counter
131 Number of received coins according to each denomination
132 Number of received coins according to each denomination during test mode

The invention claimed is:

1. A coin processing device being supplied with electric power from a vending machine, which receives a response command from the vending machine including a reset signal which represents restart execution, and responds to the received response command, comprising operation reception means for receiving an operation for executing and releasing a test mode, test mode execution means for executing the test mode according to the operation received by the operation reception means, device information storage means for storing device information present immediately before the test mode is executed, when the test mode execution means executes the test mode, if the response command from the vending machine is received while the test mode execution means executes the test mode, response means carries out a response to the response command based on the device information stored in the device information storage means, while the test mode execution means executes the test mode, reception information storage means stores reception information of thrown coins, and when the test mode is released according to the operation received by the operation reception means, paying out means pays out coins based on the storage of the reception information storage means.

2. The coin processing device claimed in claim 1, wherein while the test mode execution means executes the test mode, the reception information storage means stores the thrown coins reception information as a number of coins according to each denomination.

* * * * *